US012044125B2

(12) United States Patent
Xuan et al.

(10) Patent No.: US 12,044,125 B2
(45) Date of Patent: Jul. 23, 2024

(54) ISOLATED OVERBURDEN GROUTING FILLING METHOD FOR COAL GANGUE UNDERGROUND EMISSION REDUCTION

(71) Applicant: China University of Mining and Technology, Jiangsu (CN)

(72) Inventors: Dayang Xuan, Jiangsu (CN); Jian Li, Jiangsu (CN); Jialin Xu, Jiangsu (CN)

(73) Assignee: China University of Mining and Technology, Jiangsu (CN)

( * ) Notice: Subject to any disclaimer, the term of this patent is extended or adjusted under 35 U.S.C. 154(b) by 0 days.

(21) Appl. No.: 18/275,409

(22) PCT Filed: May 27, 2022

(86) PCT No.: PCT/CN2022/095543
§ 371 (c)(1),
(2) Date: Aug. 2, 2023

(87) PCT Pub. No.: WO2023/029617
PCT Pub. Date: Mar. 9, 2023

(65) Prior Publication Data

US 2024/0102343 A1 Mar. 28, 2024

(30) Foreign Application Priority Data

Aug. 30, 2021 (CN) ..... 202111001931.X

(51) Int. Cl.
*E21B 33/13* (2006.01)
*E02D 3/12* (2006.01)
(Continued)

(52) U.S. Cl.
CPC ..... *E21B 7/04* (2013.01); *E02D 3/12* (2013.01); *E21B 7/20* (2013.01); *E21F 15/06* (2013.01); *E21C 41/18* (2013.01); *E21F 15/08* (2013.01)

(58) Field of Classification Search
CPC ..... E21C 41/18; E21C 41/16; E21B 47/04; E21B 33/146; E21B 33/13; E21B 7/20; E21F 15/06; E21F 15/08
See application file for complete search history.

(56) References Cited

U.S. PATENT DOCUMENTS

2016/0305245 A1* 10/2016 Ma ..... E21C 41/18
2018/0195386 A1* 7/2018 Ma ..... E21F 15/00
(Continued)

FOREIGN PATENT DOCUMENTS

CN 1782327 6/2006
CN 102704933 10/2014
(Continued)

OTHER PUBLICATIONS

"International Search Report (Form PCT/ISA/210) of PCT/CN2022/095543," mailed on Aug. 4, 2022, with English translation thereof, pp. 1-5.

*Primary Examiner* — Carib A Oquendo
(74) *Attorney, Agent, or Firm* — JCIPRNET

(57) ABSTRACT

An isolated overburden grouting filling method for coal gangue underground emission reduction includes determining a grouting filling key stratum according to information of a coal face; constructing a directional borehole from an underground tunnel to the inside of the grouting filling key stratum; constructing a plurality of branch holes downward in a main hole of the directional borehole; and by establishing a grouting filling system under a mine, gangue obtained from excavation gangue of the mine and gangue sorting being made into a filling slurry by means of breaking and grinding, and the filling slurry filling fractures below the key stratum through the directional borehole. The gangue generated from a mine is directly made into a filling slurry under the mine and then fills overburden mining-induced fractures, thereby achieving harmless disposal of the gangue, effec-
(Continued)

tively supporting a key stratum, and controlling stratum movement and surface subsidence.

10 Claims, 2 Drawing Sheets

(51) Int. Cl.

| | |
|---|---|
| ***E21B 7/04*** | (2006.01) |
| ***E21B 7/20*** | (2006.01) |
| ***E21F 15/06*** | (2006.01) |
| *E21C 41/18* | (2006.01) |
| *E21F 15/08* | (2006.01) |

(56) References Cited

U.S. PATENT DOCUMENTS

| | | | | |
|---|---|---|---|---|
| 2019/0308229 | A1* | 10/2019 | Yost | B09B 5/00 |
| 2020/0300090 | A1* | 9/2020 | Ju | E21C 41/16 |
| 2020/0378256 | A1* | 12/2020 | Zhang | E21F 15/06 |
| 2023/0075452 | A1* | 3/2023 | Wang | E21B 47/005 |

FOREIGN PATENT DOCUMENTS

| | | |
|---|---|---|
| CN | 104373126 | 2/2015 |
| CN | 105422170 | 3/2016 |
| CN | 209818103 | 12/2019 |
| CN | 111485912 | 8/2020 |
| CN | 113605970 | 11/2021 |
| JP | 2016037406 | 3/2016 |

* cited by examiner

ISOLATED OVERBURDEN GROUTING FILLING METHOD FOR COAL GANGUE UNDERGROUND EMISSION REDUCTION

CROSS-REFERENCE TO RELATED APPLICATION

This application is a 371 of international application of PCT application serial no. PCT/CN2022/095543, filed on May 27, 2022, which claims the priority benefit of China application no. 202111001931.X, filed on Aug. 30, 2021. The entirety of each of the above mentioned patent applications is hereby incorporated by reference herein and made a part of this specification.

TECHNICAL FIELD

The present disclosure relates to a method for coal gangue underground emission reduction, especially suitable for an isolated overburden grouting filling method for coal gangue underground emission reduction.

BACKGROUND

Coal gangue is an important part of coal-based bulk solid waste and has the characteristics of large quantity and wide area. The traditional ground stacking leads to a series of problems such as the land occupation and the pollution, and has a serious impact on the environment of mining areas. The harmless disposal of the coal gangue has become a key issue concerning the sustainable development of mining areas. After the coal gangue is made into a suitable slurry, the grouting filling technology is utilized to fill the slurry into the mining fractures in the overburden, which can not only realize the purpose of the coal gangue emission reduction, but also achieve multiple purposes such as strata control and surface subsidence reduction.

Patent ZL2012101649299 discloses "Grouting And Filling Mining Method Based on Partition Isolated Mining Overburden" which grouts the mining fractures in the overburden strata through the ground drilling holes, so as to achieve the purposes of disposing waste, supporting the key strata of the overburden, and preventing ground subsidence. The grouting filling disclosed in this method is implemented through the ground drilling hole and the filling system. However, the source of coal gangue discharge is formed during the process of underground excavation and coal extraction, the coal gangue must be lifted to the ground for grouting and filling treatment by utilizing this method, and the purpose of processing the coal gangue at the source can not be implemented. And the construction of the grouting drilling in this method needs to occupy a certain construction site. Due to the influences of ground buildings, structures, and other factors, usually the location of the grouting drilling can not be set at an ideal position, and even the drilling can not be constructed. To sum up, the existing isolated overburden grouting filling technology cannot be applied to the mine coal gangue for underground in-situ processing. Therefore, there is an urgent need for a new isolated overburden grouting filling method for coal gangue underground emission reduction to achieve the purpose of underground in-situ harmless disposal of coal gangue during the coal mining.

SUMMARY

In order to solve the above-mentioned technical problems, an isolated overburden grouting filling method for coal gangue underground emission reduction is provided. The steps of the method are as follows.

In Step a, key strata in an overburden are distinguished according to mining parameters and geological information on a coal mining face, one of the key strata with a thicker thickness is selected as a grouting filling key stratum according to requirements for a surface subsidence control and a gangue filling processing volume, and a lower boundary of the grouting filling key stratum is a selected grouting filling horizon.

In Step b, a position is selected as a drilling site from a roadway outside a terminal line of the coal mining face, an underground directional hole is constructed in a direction of the grouting filling key stratum from the drilling site, a first drilling drill-hole of the underground directional hole is an inclined hole, a direction of the first drilling drill-hole is a direction of an open-cut off in the coal mining face, a trajectory of the inclined hole is spaced at a certain distance from a boundary of a water conducting fractured zone on the coal mining face, after the underground directional hole enters the grouting filling key stratum, the underground directional hole is continuously drilled forwardly for a certain distance in a direction of the open-cut off in the coal mining face along a middle plane of the key stratum, a drilling direction is parallel to an advancing direction of the coal mining face, subsequently a high-strength casing is inserted, and a cementing of the first drilling drill-hole is completed with a cement slurry.

Preferably, in Step b, the drilling site is constructed in an uphill roadway.

Preferably, in Step b, an angle of the inclined hole is selected within a feasible range of construction according to a distance between the drilling site and the terminal line of the coal mining face, and a minimum vertical distance between the trajectory of the inclined hole and the boundary of the water conducting fractured zone on the coal mining face ranges from 40 m to 50 m.

Preferably, in Step b, the drilling is stopped after the underground directional hole is continuously drilled forwardly for a distance of 30 m in the direction of the open-cut off in the coal mining face, for inserting a high-strength casing.

In Step c, a main hole is continuously drilled forwardly along the middle plane of the grouting filling key stratum, a projection of a drilling trajectory on a horizontal plane is parallel to the advancing direction of the coal mining face, the main hole is inclined downward, and the drilling is stopped when the main hole is drilled to a distance of 50 m away from the open-cut off in the coal mining face.

Preferably, in Step c, the main hole is inclined downward by 3‰ to 5‰.

In Step d, starting from a drill-hole ended point of the main hole, a group of obliquely downward branch holes are constructed at regular intervals along an axis direction of the underground directional hole, each group of branch holes consists of one or more rows, and the rows are as backups for each other in each group, a drill-hole ended point of each branch hole is located below the lower boundary of the grouting filling key stratum, and above a top boundary of the water conducting fractured zone of the coal mining face.

Preferably, in Step d, each row of branch holes consists of 3 to 5 branch holes arranged in a fan-shape manner.

Preferably, in Step d, the drill-hole ended points of the branch holes are located 20 m to 50 m below the lower boundary of the grouting filling stratum, and 30 m to 50 m above the top boundary of the water conducting fractured zone on the coal mining face.

In Step e, after the construction of all branch holes is completed, a non-consolidated high-viscosity filler is injected into the main hole and the branch holes through an orifice of the underground directional hole to fill all branch holes and an interior of the main hole of the underground directional hole.

Preferably, in Step e, gelatin, yellow mud or polymer and the like is adopted as the non-consolidated high-viscosity filler.

Preferably, in Step e, all the branch holes and the interior of the main hole of the underground directional hole are filled to play a role of temporarily closing the branch holes, with no solidification to block the branch holes, and then a stable pressure is maintained at the orifice.

The construction of the underground directional hole is completed before mining in the coal mining face, one or more underground directional holes are arranged according to parameters such as a width of the coal mining face, a diffusion radius of the slurry, and a demand for the filling volume.

In Step f, when the coal mining face is mined at the drill-hole ended point of the branch holes in a first row of a first group, a low-concentration gangue slurry is injected into the main hole through the orifice of the underground directional hole according to an attenuation of a drill-hole pressure, with the coal mining face passing through the branch holes in the first row of the first group, a slurry concentration and a grouting volume are continuously increased according to a change of the drill-hole pressure, thereby forming a grouting filling horizon.

The grouting filling system is built underground without occupying land resources on a ground. The gangue comes from an underground roadway excavation and a selected gangue, is stored and buffered in the filling system, and is crushed and milled to make gangue powder, the gangue powder is mixed with water to make gangue slurry for filling, or is directly mixed with water in a process of crushing and grinding to make the gangue slurry.

In Step g, with a continuous mining of the coal mining face, the fractures in the grouting filling horizon are spread forwardly, when the coal mining face approaches the branch holes in a subsequent row, the fractures in the grouting filling horizon are communicated with the branch holes in the subsequent row to form a communication channel of main hole-branch hole-grouting filling stratum horizon.

Preferably, in Step g, since a grouting pressure at the connection point between a subsequent branch hole and the main hole is higher than a pressure at a bottom of the branch hole, the gangue slurry in the main hole is promoted to flow into the branch hole to squeeze fillers in the branch hole into the fractures in the grouting filling horizon, and enable the branch hole to be a grouting filling channel, thereby starting the grouting filling of the branch hole.

In Step h, with the coal mining face being continuously mined forwardly, a grouting is continuously implemented to fill the fractures below the grouting filling key stratum through the main hole, due to an effect of the pressure, a lower caved and a fractured zone rock mass are squeezed downwards, and the grouting filling key stratum is supported upwards, thereby increasing opening degrees of the fractures, greatly increasing the grouting volume and processing the underground gangue, effectively supporting the grouting filling key stratum, and effectively controlling the overburden and surface deformation until the mining of the coal mining face is completed.

Beneficial Effects

1. The present disclosure directly makes the coal gangue generated from the mine into the filling slurry in the underground and then fills into the mining fractures in the overburden through building the grouting filling system in the underground and constructing the directional drill-hole in the overburden key stratum, which can directly dispose the gangue produced in the underground in a harmless manner, and achieves the goal of not lifting the gangue into the ground, reduces the lifting costs, and avoids the problems of land occupation and pollution in the prior art when the gangue is piled on the ground first and then filled, and also solves the problem of difficult site selection for ground drilling.
2. The underground directional hole adopted in the present disclosure has a main hole located inside the grouting filling key stratum, due to the large thickness of the selected key stratum, the key stratum will sink as a whole, resulting in a small deformation and a less damage to the directional hole; the surface borehole method in the prior art requires to pass through rock strata of different heights, with significant differences in subsidence between each layer, resulting in a large deformation and an easy damage to the drilling hole. The present disclosure effectively eliminate this deficiency.
3. In the main hole and branch hole method of the present disclosure, only one main hole is required in most cases, and the engineering quantity of the branch hole is extremely small, with a relatively small total engineering quantity, while in the vertical surface borehole method, the quantity of the boreholes is increased with changes on the advancing length of the working face, and the total engineering quantity of the boreholes is too huge in the working face with a large cover depth, which is effectively eliminated by the present disclosure. In the branch hole method of the present disclosure, due to a small engineering quantity, a plurality of branch holes can be arranged in one filling area, which plays a role of increasing the grouting volume, serving as backup for each other and improving the safety factor, however, the surface holes can not be constructed excessively limited by the engineering quantity and costs.
4. The method of the present disclosure that the filler is filled in the branch holes, can not only avoid the blockage of the branch holes before the fractures communicate with the branch holes, but also implement grouting filling after the fractures communicate with the branch holes, thereby eliminating the problems of branch hole collapse and slurry blockage that are easily caused by traditional construction techniques.

In the figures: 1. Coal mining face; 2. Grouting filling key stratum; 3. Terminal line of coal mining face; 4. Roadway; 5. Underground directional hole; 6. first drilling hole; 7. Open-off cut; 8. Water Conducting Fractured zone on coal mining face; 9. Advancing direction of coal mining face; 10. Branch hole; 11. Branch hole in first row of first group; 12. Main hole; 13. Grouting filling horizon.

DETAILED DESCRIPTION OF THE EMBODIMENTS

The present disclosure will be further described with reference to the accompanying drawings.

Figure 1:
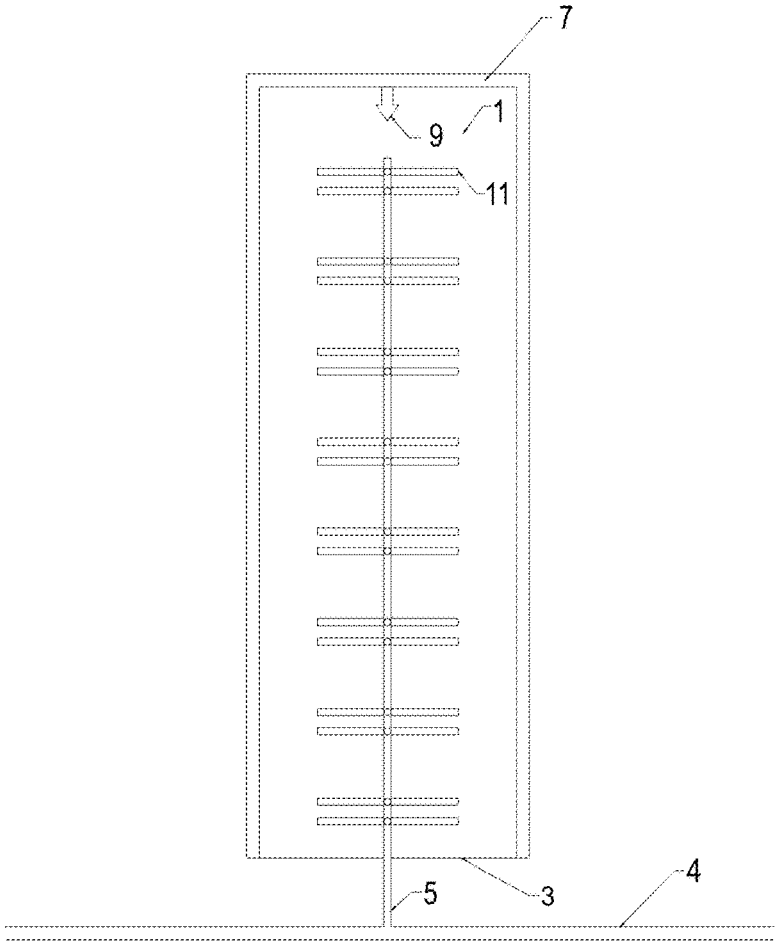
FIG. 1 illustrates a plan view of an arrangement of a coal mining face and an underground directional hole in the present disclosure.
Figure 2:
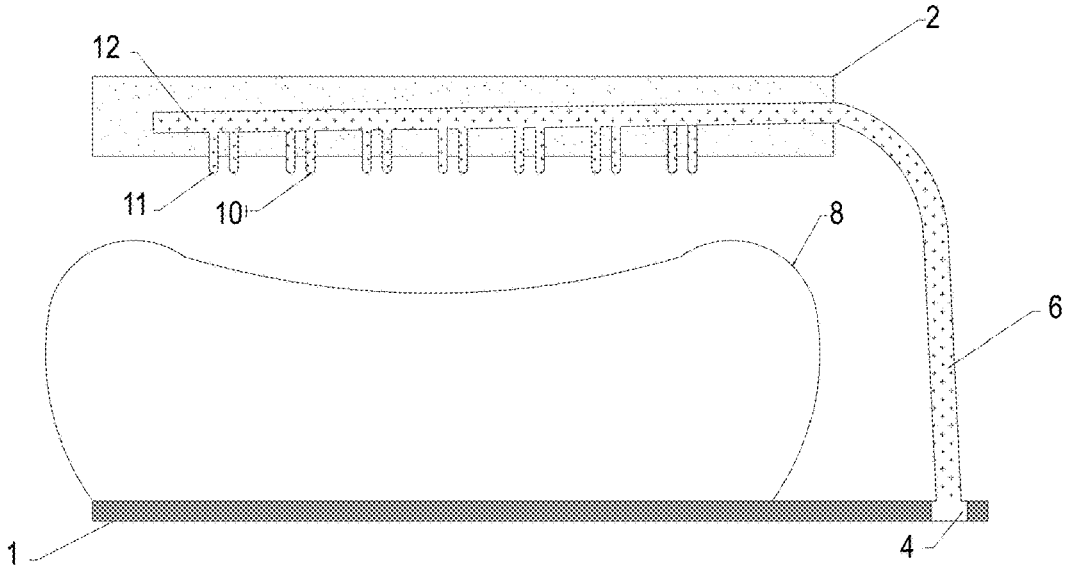
FIG. 2 illustrates a cross-sectional view of an arrangement strike of the coal mining face and the underground directional hole in the present disclosure.
Figure 3:
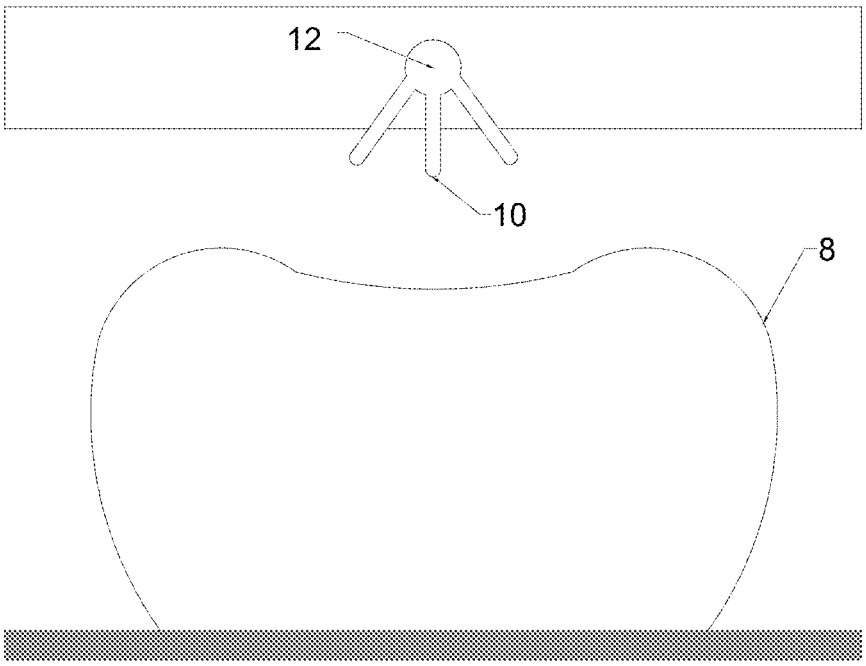
FIG. 3 illustrates a cross-sectional of an arrangement tendency of the coal mining face and the underground directional hole in the present disclosure.
Figure 4:
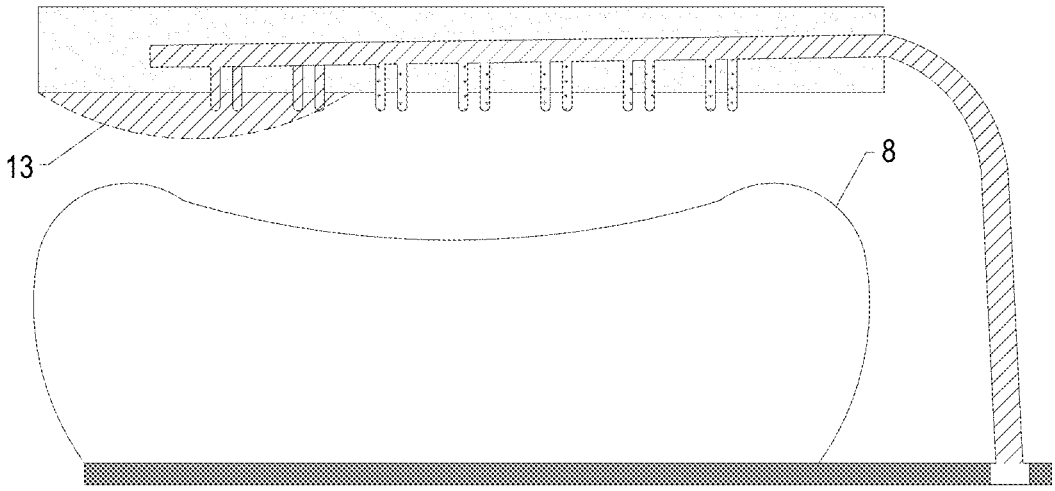
FIG. 4 illustrates a diagram of a fracture development and a branch hole filling in the grouting filling horizon when a plurality of branch holes is grouted and filled in the present disclosure.

As illustrated in FIG. 1, an isolated overburden grouting filling method for coal gangue underground emission reduction in the present disclosure comprises the following steps.

In Step a, key strata in an overburden are distinguished according to mining parameters and geological information on a coal mining face 1. One of the key strata with a thicker thickness is selected as a grouting filling key stratum 2 according to requirements for a surface subsidence control and a gangue filling processing volume, and a lower boundary of the grouting filling key stratum 2 is a selected grouting filling horizon.

In Step b, a position is selected as a drilling site from a roadway 4 (such as uphill roadway and the like) outside a terminal line 3 of the coal mining face. An underground directional hole 5 is constructed in a direction of the grouting filling key stratum 2 from the drilling site. A first drilling hole 6 of the underground directional hole 5 is an inclined hole, a direction of the first drilling hole 6 is a direction of an open-cut off 7 in the coal mining face. An angle of the inclined hole is selected within a feasible range of construction according to a distance between the drilling site and the terminal line 3 of the coal mining face, and a minimum vertical distance between the trajectory of the inclined hole and the boundary of the water conducting fractured zone 8 on the coal mining face ranges from 40 m to 50 m. After the underground directional hole 5 enters the grouting filling key stratum 2, the underground directional hole 5 is continuously drilled forwardly in a direction of the open-cut off 7 in the coal mining face along a middle plane of the key stratum, the drilling is stopped after drilling forwardly for a distance of 30 m, the drilling direction is parallel to the advancing direction 9 of the coal mining face, a high-strength casing is inserted and the cementing of the first drilling hole 6 is completed with the cement slurry.

In Step c, after the cementing of the first drilling drill-hole 6 is completed, the main hole 12 is continuously drilled forwardly along the middle plane of the grouting filling key stratum. A projection of a drilling trajectory on a horizontal plane is parallel to the advancing direction 9 of the coal mining face. The main hole 12 is inclined downward by 3‰ to 5‰, and the drilling is stopped when the main hole is drilled to a distance of 50 m away from the open-cut off 7 in the coal mining face.

In Step d, starting from a drill-hole ended point of the main hole 12, a group of obliquely downward branch holes 10 are constructed at regular intervals along an axis direction of the underground directional hole 5. Each group of branch holes 10 consists of one or more rows, each row consists of 3 to 5 branch holes arranged in a fan-shape manner. The rows are as backups for each other in each group, the drill-hole ended point of each branch hole 10 is located 20 m to 50 m below the lower boundary of the grouting filling key stratum 2, and 30 m to 50 m above the top boundary of the water conducting fractured zone 8 on the coal mining face.

In Step e, after the construction of all branch holes 10 is completed, the non-consolidated high-viscosity filler (such as gelatin, yellow mud, polymer) is injected into the main hole 12 and the branch holes 10 through an orifice of the underground directional hole 5, which fills all the branch holes 10 and the interior of the main hole of the underground directional hole and plays a role of temporarily closing the branch holes, with no solidification to block the branch holes 10, and then a stable pressure is maintained at the orifice.

The construction of the underground directional hole 5 is completed before mining in the coal mining face 1. One or more directional holes 5 are arranged according to parameters such as the width of the coal mining face 1, the diffusion radius of the slurry, and the demand for the filling volume.

In Step f, after the coal mining face 1 starts mining, when the coal mining face is mined at the drill-hole ended point of the branch hole 11 in the first row of the first group, the low-concentration gangue slurry is injected into the main hole 12 through the orifice of the underground directional hole 5 according to an attenuation of the drill-hole pressure. With the coal mining face passing through the branch holes 11 in the first row of the first group, a slurry concentration and a grouting volume are continuously increased according to a change of the drill-hole pressure, thereby forming the grouting filling horizon 13. During the grouting filling process of the branch hole 11 in the first row of the first group, since the fractures in the grouting filling horizon 13 have not developed to the subsequent branch holes, the fillers in the subsequent branch holes still do not leak, thus blocking the gangue slurry from flowing into the subsequent branch holes, and avoiding the blockage of the subsequent branch holes caused by the sedimentation of the gangue particles.

The grouting filling system is built underground without occupying land resources on a ground. The gangue comes from an underground roadway excavation and a selected gangue. The gangue is stored and buffered in the filling system, and is crushed and milled to make gangue powder. The gangue powder is mixed with water to make gangue slurry for filling, or is directly mixed with water in a process of crushing and grinding to make the gangue slurry.

In Step g, with the continuous mining of the coal mining face 1, the fractures in the grouting filling horizon 13 are spread forwardly. When the coal mining face 1 approaches the branch holes in a subsequent row, the fractures in the grouting filling horizon 13 are communicated with the branch holes in the subsequent row to form a communication channel of main hole 12-branch hole 10-grouting filling horizon 13. At this time, since a grouting pressure at the connection point between the subsequent branch hole and the main hole 12 is higher than a pressure at a bottom of the branch hole 10, the gangue slurry in the main hole 12 is promoted to flow into the branch hole 10 to squeeze fillers in the branch hole 10 into the fractures in the grouting filling horizon 13, and enable the branch hole 10 to be a grouting filling channel, thereby starting the grouting filling of the branch hole.

In Step h, with the coal mining face being continuously mined forwardly, a grouting is continuously implemented to fill the fractures below the grouting filling key stratum 2 through the main hole 12. Due to an effect of the pressure, a lower caved and a fractured zone rock mass are squeezed downwards, and the grouting filling key stratum 2 is supported upwards, thereby increasing opening degrees of the fractures, greatly increasing the grouting volume and processing the underground gangue, effectively supporting the grouting filling key stratum 2, and effectively controlling the overburden and the surface deformation until the mining of the coal mining face 1 is completed.

What is claimed is:

1. An isolated overburden grouting filling method for coal gangue underground emission reduction, comprising following steps:

a, distinguishing, according to mining parameters and geological information on a coal mining face, key strata in an overburden; selecting, according to requirements for a surface subsidence control and a gangue filling processing volume, one of the key strata with a thicker thickness as a grouting filling key stratum, wherein a lower boundary of the grouting filling key stratum is a selected grouting filling horizon;

b, selecting, from a roadway outside a terminal line of the coal mining face, a position as a drilling site; constructing an underground directional hole in a direction of the grouting filling key stratum from the drilling site, wherein a first drilling drill-hole of the underground directional hole is an inclined hole, a direction of the first drilling drill-hole is a direction of an open-cut off in the coal mining face, a trajectory of the inclined hole is spaced at a certain distance from a boundary of a water conducting fractured zone on the coal mining face; continuously drilling forwardly, after the underground directional hole enters the grouting filling key stratum, for a certain distance in the direction of the open-cut off in the coal mining face along a middle plane of the key stratum, wherein a drilling direction is parallel to an advancing direction of the coal mining face; subsequently inserting a high-strength casing, and completing a cementing of the first drilling drill-hole with a cement slurry;

c, continuously drilling forwardly, along the middle plane of the grouting filling key stratum, a main hole, wherein a projection of a drilling trajectory on a horizontal plane is parallel to the advancing direction of the coal mining face, the main hole is inclined downward; stopping, when drilling the main hole to a distance of 50 m away from the open-cut off in the coal mining face, the drilling;

d, constructing, starting from a drill-hole ended point of the main hole, a group of obliquely downward branch holes at regular intervals along an axis direction of the underground directional hole, wherein each group of the branch holes consists of one or more rows, and the rows are as backups for each other in each group, a drill-hole ended point of each branch hole is located below the lower boundary of the grouting filling key stratum, and above a top boundary of the fractured zone on the coal mining face;

e, injecting, after completing the construction of all branch holes, a non-consolidated high-viscosity filler into the main hole and branch holes through an orifice of the underground directional hole to fill all branch holes and an interior of the main hole of the underground directional hole;

f, injecting, when the coal mining face is mined at the drill-hole ended points of the branch holes in a first row of a first branch, a low-concentration gangue slurry into the main hole through the orifice of the underground directional hole according to an attenuation of a drill-hole pressure; continuously increasing, with the coal mining face passing through the branch holes in the first row of the first group, a slurry concentration and a grouting volume according to a change of the drill-hole pressure, thereby forming the grouting filling horizon;

g, spreading, with a continuous mining of the coal mining face, fractures in the grouting filling horizon forwardly; communicating, when the coal mining face approximates to the branch holes in a subsequent row, the fractures in the grouting filling horizon with the branch holes in the subsequent row to form a communication channel of main hole-branch hole-grouting filling horizon; and h, continuously grouting, with the coal mining face being continuously mined forwardly, to the fractures below the grouting filling key stratum through the main hole, wherein due to an effect of a pressure, a lower caved and a fractured zone rock mass are squeezed downwards, and the grouting filling key stratum is supported upwards, thereby increasing opening degrees of the fractures, greatly increasing the grouting volume and processing the underground gangue, effectively supporting the grouting filling key stratum, and effectively controlling the overburden and surface deformation until the mining of the coal mining face is completed.

2. The method according to claim 1, wherein in Step b, the drilling site is constructed in an uphill roadway.

3. The method according to claim 1, wherein in Step b, an angle of the inclined hole is selected within a feasible range of construction according to a distance between the drilling site and the terminal line of the coal mining face, and a minimum vertical distance between the trajectory of the inclined hole and the boundary of the water conducting fractured zone on the coal mining face ranges from 40 m to 50 m.

4. The method according to claim 1, wherein in Step b, the drilling is stopped after continuously drilling forwardly for a distance of 30 m in the direction of the open-cut off in the coal mining face, for inserting the high-strength casing.

5. The method according to claim 1, wherein in Step c, the main hole is inclined downward by 3‰ to 5‰.

6. The method according to claim 1, wherein in Step d, each row of branch holes consists of 3 to 5 branch holes arranged in a fan-shape manner, and/or the drill-hole ended points of the branch holes are located 20 m to 50 m below the lower boundary of the grouting filling key stratum, and 30 m to 50 m above the top boundary of the water conducting fractured zone on the coal mining face.

7. The method according to claim 1, wherein in Step e, gelatin or yellow mud is adopted as the non-consolidating high-viscosity filler, and/or all branch holes and the interior of the main hole of the underground directional hole are filled to play a role of temporarily closing the branch holes, with no solidification to block the branch holes, and a stable pressure is maintained at the orifice.

8. The method according to claim 1, wherein in Step g, since a grouting pressure at the connection point between a subsequent branch hole and the main hole is higher than a pressure at a bottom of the branch hole, the gangue slurry in the main hole is promoted to flow into the branch hole to squeeze fillers in the branch hole into the fractures in the grouting filling horizon, and enable the branch hole to be a grouting filling channel, thereby starting the grouting filling of the branch hole.

9. The method according to claim 1, wherein a construction of the underground directional hole is completed before mining in the coal mining face, and one or more underground directional holes are arranged according to a width of the coal mining face, a diffusion radius of the slurry, and a requirement for the filling volume.

10. The method according to claim 1, wherein the grouting filling system is built underground without occupying land resources on a ground, the gangue comes from an underground roadway excavation and a selected gangue, is stored and buffered in the filling system, and is crushed and milled to make gangue powder, the gangue powder is mixed with water to make gangue slurry for filling, or is directly mixed with water in a process of crushing and grinding to make the gangue slurry.

* * * * *